US006467100B2

(12) United States Patent
Leach

(10) Patent No.: US 6,467,100 B2
(45) Date of Patent: Oct. 22, 2002

(54) WATER CONSERVATION APPARATUS FOR TOILET

(75) Inventor: Jeff Leach, 702 Turnstone Dr., Arlington, TX (US) 76018

(73) Assignee: Jeff Leach, Arlington, TX (US)

( * ) Notice: Subject to any disclaimer, the term of this patent is extended or adjusted under 35 U.S.C. 154(b) by 0 days.

(21) Appl. No.: 09/933,522

(22) Filed: Aug. 20, 2001

(65) Prior Publication Data

US 2002/0023295 A1 Feb. 28, 2002

Related U.S. Application Data

(60) Provisional application No. 60/229,211, filed on Aug. 31, 2000.

(51) Int. Cl.[7] ..... E03D 1/14
(52) U.S. Cl. ..... 4/325
(58) Field of Search ..... 4/324, 325, 379

(56) References Cited

U.S. PATENT DOCUMENTS 3,775,778 A * 12/1973 Lee ..... 4/325
4,391,003 A * 7/1983 Talerico et al. ..... 4/325 X
4,620,331 A * 11/1986 Sagucio ..... 4/325
5,175,893 A * 1/1993 Navarrete ..... 4/326
5,414,877 A * 5/1995 Tsai et al. ..... 4/325
5,515,553 A * 5/1996 Charriere et al. ..... 4/325
5,519,898 A * 5/1996 Guo et al. ..... 4/325

* cited by examiner

*Primary Examiner*—Charles E. Phillips
(74) *Attorney, Agent, or Firm*—Hill & Hunn Attorneys; James Walton

(57) ABSTRACT

A water conservation apparatus for use in a toilet having a dual action handle that is connected to an adjustable activating rod. The adjustable activating rod is connected to both a first pull chain for effectuating a full tank flush and a second pull chain for effectuating a limited flush. A spring loaded release control mechanism is coupled to the adjustable rod to regulate the pivotal movement of the dual action handle and the adjustable activating rod. A stabilizing jackscrew assembly is carried by the spring loaded release control mechanism to secure the apparatus in the toilet tank.

5 Claims, 8 Drawing Sheets

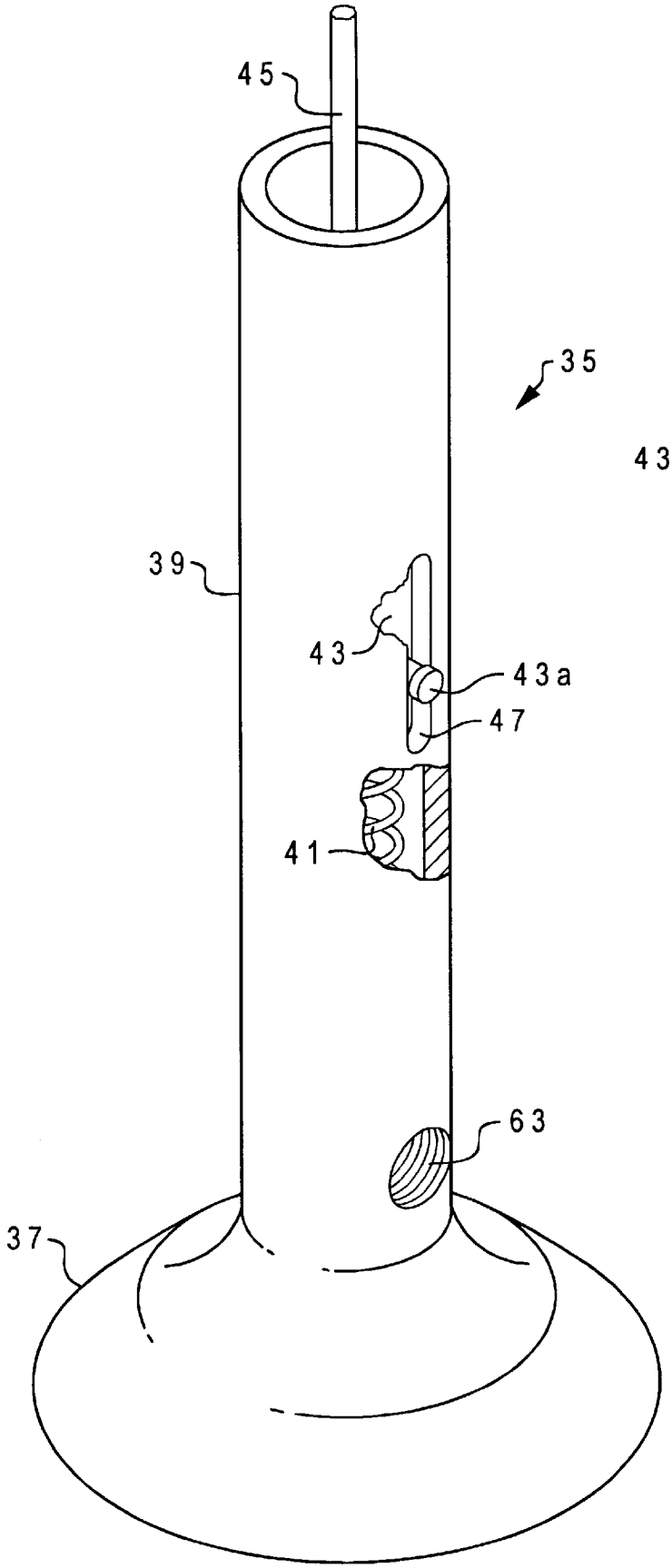
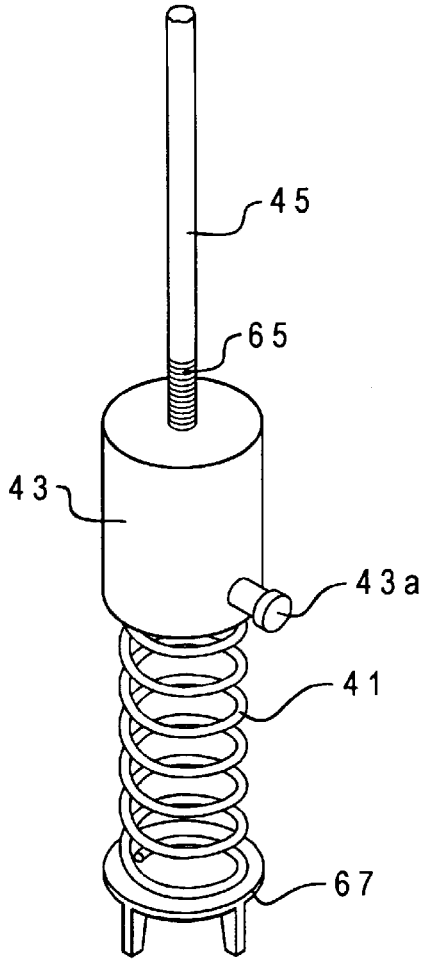
Fig. 3B
Fig. 3A

WATER CONSERVATION APPARATUS FOR TOILET

This application claims the benefit of U.S. Provisional Application No. 60/229,211, filed Aug. 31, 2000, titled "Water Conservation Apparatus for Toilet."

BACKGROUND ART

1 Field of the Invention

The present invention relates to water conservation apparatuses. In particular, the present invention relates to a water conservation apparatus for use in toilets.

2. Description of Related Art

Water conservation has always been an important issue. Each person in the United States uses about 100 gallons of water every day on the average. With population numbers on the rise, water conservation becomes a serious heap.

Water used in flushing toilets is a major contributor to water use. Until recently, a typical toilet would use 4 to 6 gallons of water per flush. In an effort to conserve water, toilets have been designed to flush with as little as 1.6 gallons of water. Although this represents a marked increase, this does nothing for the millions of existing toilets in the United States that still require 4 to 6 gallons of water to flush.

BRIEF SUMMARY OF THE INVENTION

There is a need for a water conservation apparatus for use in toilets with which the user can limit the amount of water used per flush.

It is an object of the present invention to provide a water conservation apparatus for use in existing toilets with which the user can regulate the amount of water used per flush.

It is another object of the present invention to provide a toilet of original manufacture which includes a water conservation apparatus with which the user can regulate the amount of water used per flush.

It is another object of the present invention to provide a dual-action toilet handle and transfer assembly for regulating the amount of water used during each flush of the toilet.

The above objects are achieved by providing a water conservation apparatus for use in a toilet having a dual action handle that is connected to an adjustable activating rod. The adjustable activating rod is connected to both a first pull chain for effectuating a full tank flush and a second pull chain for effectuating a limited flush. A spring loaded release control mechanism is coupled to the adjustable rod to regulate the pivotal movement of the dual action handle and the adjustable activating rod. A stabilizing jackscrew assembly is carried by the spring loaded release control mechanism to secure the apparatus in the toilet tank.

The present invention has significant advantages, including: (1) the ability to convert a full flow toilet tank into a limited flow toilet tank; (2) the ability to flush only a limited amount of water per flush; (3) the apparatus can be installed as a retrofit into existing toilets or installed in a toilet of original manufacture; and (4) the apparatus of the present invention will conserve millions of gallons of water per year, thereby significantly contributing to the water conservation effort.

The above objects and advantages, as well as others, will be evident from the following detailed description of the present invention.

BRIEF DESCRIPTION OF THE DRAWINGS

FIG. 3A is a prospective view of the spring loaded release control mechanism of the apparatus of FIG. 1.

FIG. 3B is a prospective view of the spring assembly of the spring loaded release control mechanism of FIG. 3A.

DETAILED DESCRIPTION OF THE PREFERRED EMBODIMENT

Figure 1:
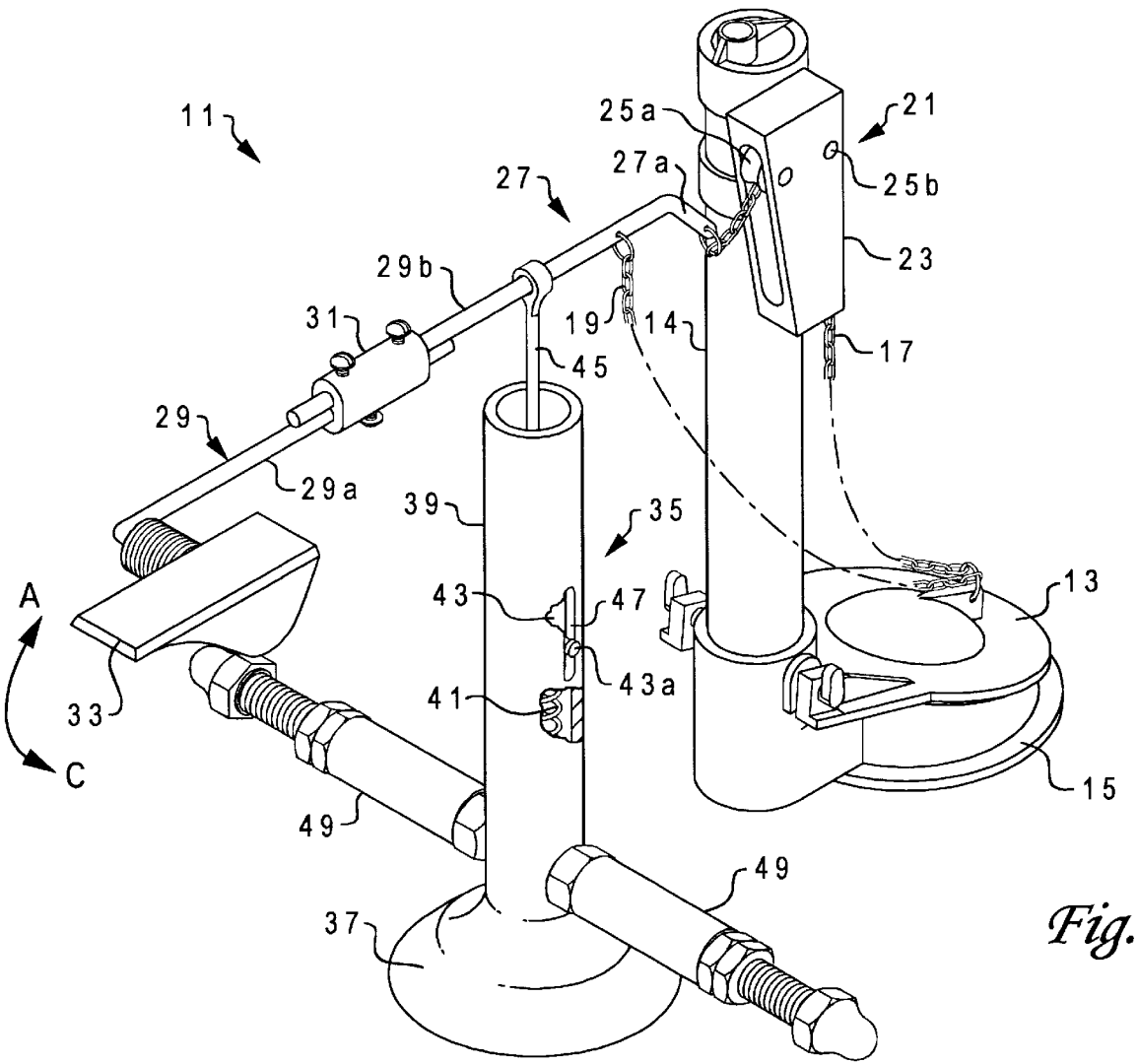
FIG. 1 is a prospective view of the water conservation apparatus for use in a toilet of the present invention.

Referring to FIG. 1 in the drawings, a water conservation apparatus 11 for use in a toilet is illustrated. Apparatus 11 is preferably disposed within the tank (not shown) of a conventional toilet (not shown). In the preferred embodiment, apparatus 11 is a retrofit in an existing conventional toilet. As such, an existing toilet flapper valve 13 is pivotally coupled to an existing flapper valve column 14. Flapper valve 13 functions to seal an existing flow outlet 15 in the toilet tank and prevent the water in the tank from being flushed until flapper valve 13 is actuated by the user. A first chain 17 and a second chain 19 are coupled to flapper valve 13. First chain 17 is fed through a two-wheel pulley assembly 21 and is then coupled to a first end portion 27 of an adjustable activating rod 29. Second chain 19 is coupled to flapper valve 13 and first end portion 27. Two-wheel pulley assembly 21 includes a housing member 23 and a pair of pulleys 25*a* and 25*b*. First chain 17 is fed over pulley 25*b* and around pulley 25*a*. First end portion 27 may be configured to provide a selected amount of translation of first chain 17. As such, first end portion 27 may include a downward bend 27A. In the preferred embodiment, second chain 19 is coupled to first end portion 27 at a location which is farther away from the end of first end portion 27 than the location where first chain 17 is coupled to first end portion 27. However, it should be understood that the locations along adjustable activating rod 19 at which first chain 17 and second chain 19 are coupled may vary according to the amount of force required to actuate adjustable activating rod 19. Adjustable activating rod includes an adjustment mechanism 31. Mechanism 31 allows for adjustment in the length of adjustment activating rod 29. Adjustment activating rod 29 is coupled to a dual action flush handle 33. Dual action flush handle 33 is configured to extend from within the tank to the exterior of the tank, similar to the configuration of conventional toilet flush handles.

A spring loaded release control mechanism 35 is coupled to adjustable activating rod 29. Spring loaded release control mechanism 35 includes a base portion 37, a sleeve portion 39, an internal spring 41, a stopper member 43 having a post-member 43*a,* and a shaft member 45. Post-member 43*a* of stopper member 43 translates in an elongated slot 47. The axial translation of shaft member 45 is restricted by the movement of post member 43*a* as post member 43*a* translates within the boundaries of elongated slot 47. In this manner, the pivotal movement of adjustable activating rod 19 is also restricted. It is preferred that spring loaded release control mechanism 35 be located closer to flapper valve 13 than dual action flush handle 33 to provide ease of movement of dual action flush handle 33. However, it should be understood that spring loaded release control mechanism 35 may be located anywhere along the length of adjustable activating rod 29.

A mounting jackscrew assembly 49 is coupled to base portion 37. Mounting jack screw assembly 49 can extend in opposing directions and be biased against the inner walls of the tank, thereby securing spring loaded release control mechanism 35 in the tank and preventing it from undesirable movement.

Figure 2A:
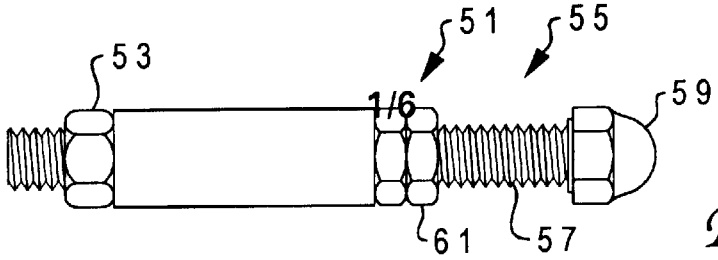
FIG. 2A is a front view of the stabilizing jackscrew assembly for the apparatus of FIG. 1.
Figure 2B:
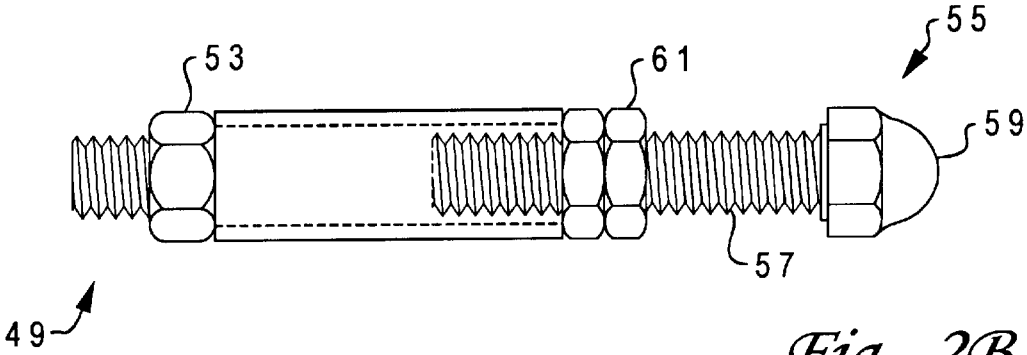
FIG. 2B is an enlarged detailed view of the stabilizing jackscrew assembly of FIG. 2A.

Refer now to FIGS. 2A and 2B in the drawings, mounting jackscrew assembly 49 is shown in detail. Mounting jackscrew assembly consists of two identical adjustment members 51. Each adjustment member 51 includes a fixed end 53 and an adjustable end 55. Each fixed end 53 is preferably threadingly coupled to base portion 37. Each adjustable end 55 includes a threaded shaft 57, a stopper 59, and a lock nut 61. Stopper 59 is preferably a rubber cap, or similar pliable material which would allow adjustment member 51 to be biased against the inside surface of the tank, without damaging the tank. To adjust the placement of spring loaded release control mechanism 35 and hold it in place, each threaded shaft 57 is extended out until stoppers 59 are biased against the opposing inside walls of the tank. Lock nuts 61 are then tightened against fixed ends 53 until adjustment members 51 are firmly in place. It should be understood that other adjustment mechanisms may be employed to secure spring loaded release control mechanism 35 in place within the tank.

Figure 3F:
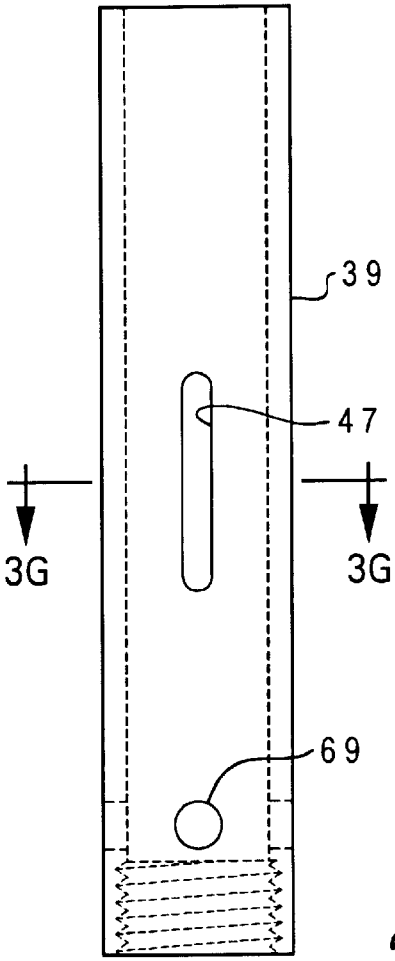
FIG. 3F is a front plan view of a sleeve portion of the spring loaded release control mechanism of FIG. 3A.
Figure 3G:
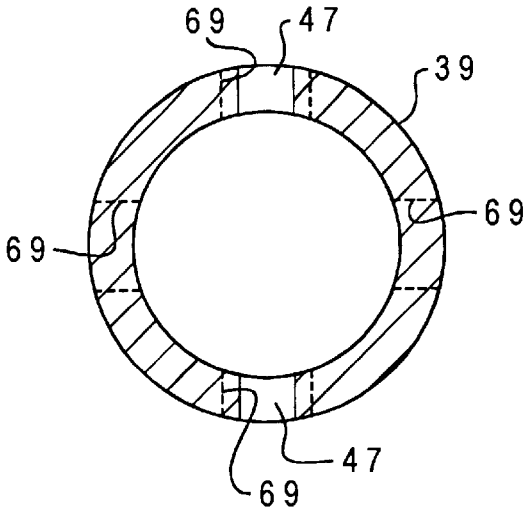
FIG. 3G is a top view of the sleeve portion of FIG. 3F.
Figure 3C:
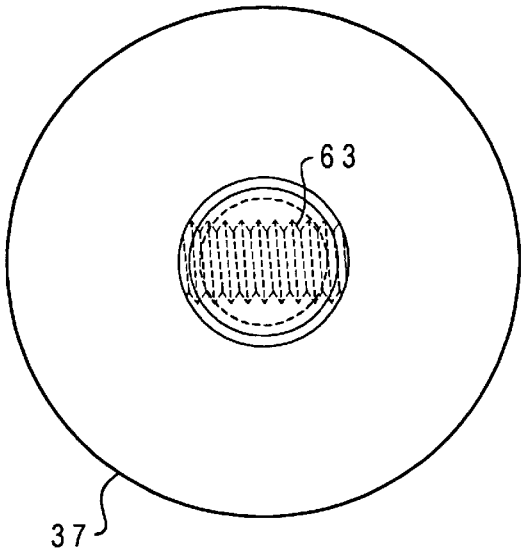
FIG. 3C is a top view of the base portion of the spring loaded release control mechanism of FIG. 3A.
Figure 3D:
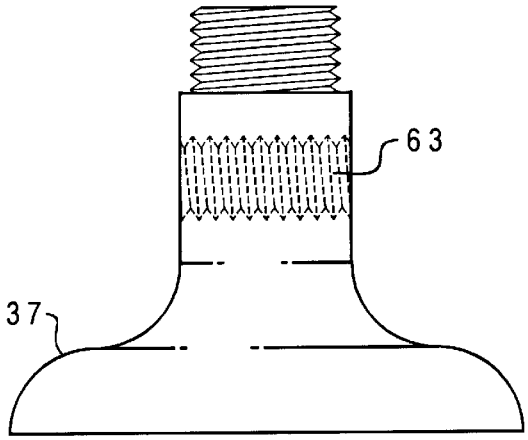
FIG. 3D is a front view of the base portion of FIG. 3C.
Figure 3E:
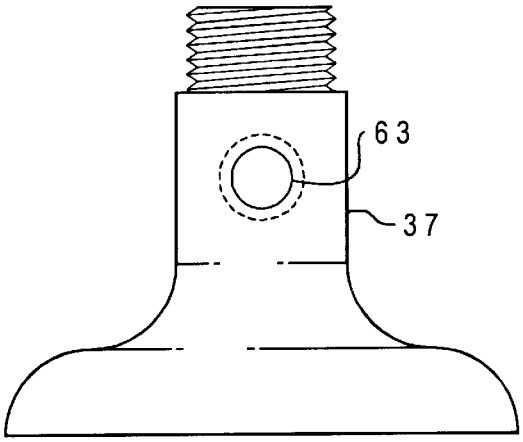
FIG. 3E is a right side view of the base portion of FIG. 3C.

Referring now to FIGS. 3A through 3G in the drawings, spring loaded release control mechanism 35 is shown in detail. As is shown, an aperture 63 is provided in base portion 37 to receive each adjustment member 51. As is best seen in FIG. 3B, shaft member 45 includes an adjustment portion 65 for adjusting the height of shaft member 45 so that shaft member 45 may be the appropriate length to couple to adjustable activating rod 29. Adjustment portion 65 is adjustably coupled to stopper member 43. Internal spring 41 is biased between stopper member 43 and a spring base member 67. Where assembled, shaft member 45, stopper member 43, internal spring 41, and spring base member 67 are disposed within sleeve portion 39 of spring loaded release control mechanism 35 in such a manner that post member 43*a* extends through elongated slot 47.

In the preferred embodiment, base portion 37 and sleeve portion 39 are integrated together into a single member. However, as is shown in FIG. 3C through 3G, base portion 37 and sleeve portion 39 may be separate components threadingly coupled together. In such an alternate embodiment, sleeve portion 39 includes a plurality of apertures 69 to receive a stabilizing pin (not shown). As is shown, sleeve portion 39 may have an additional elongated slot 47 on the opposing side of sleeve portion 37 to receive a second post member 43*a*.

Figure 4A:
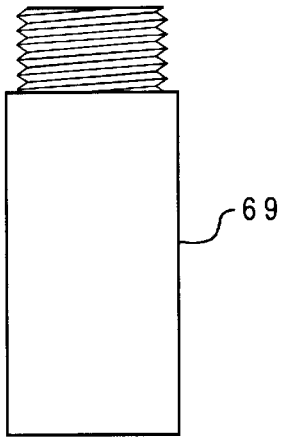
FIG. 4A is a front plan view of an alternate base portion for the spring loaded release control mechanism of FIG. 1.
Figure 4B:
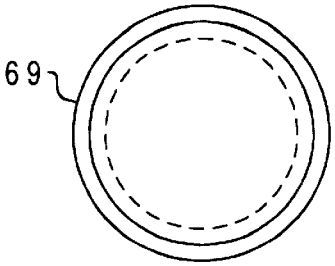
FIG. 4B is a top view of the base portion of FIG. 4A.

Referring now to FIGS. 4A and 4B in the drawings, an alternate embodiment of base portion 37 is illustrated. In this alternate embodiment, base portion 37 is replaced with base portion 69. This embodiment may be employed in apparatus 11 when installed in a toilet of original manufacture. In other words, base portion 69 would be secured to the bottom surface of the tank and would not need mounting jack screw assembly 49.

Figure 5A:
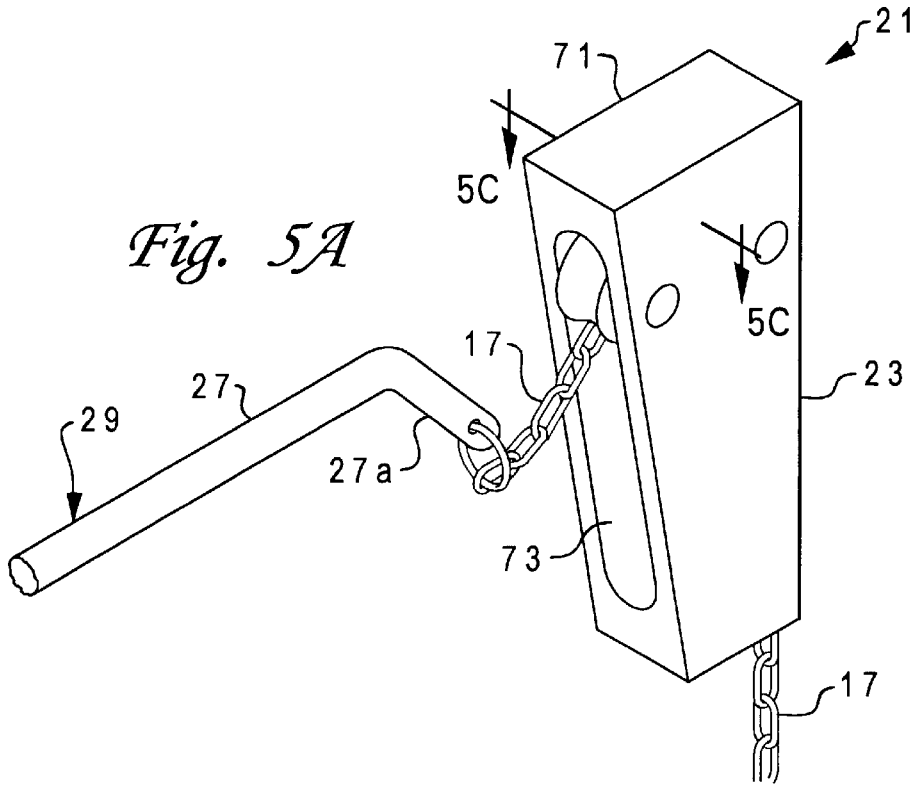
FIG. 5A is a prospective view of a pulley assembly housing for use with the apparatus of FIG. 1.
Figure 5B:
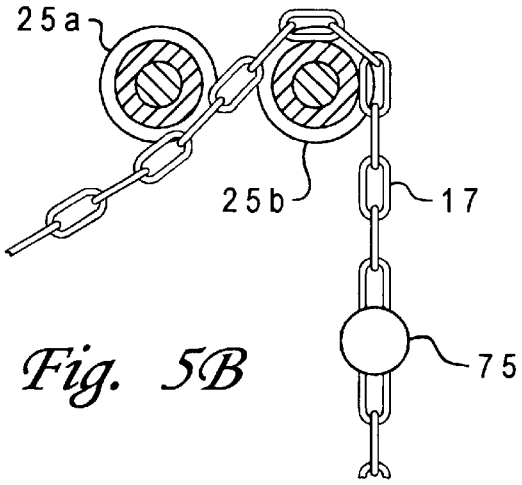
FIG. 5B is a side view of the pulley assembly of FIG. 5A.
Figure 5C:
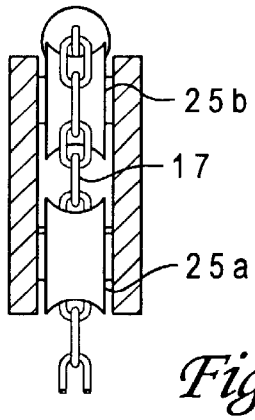
FIG. 5C is a top view of the pulley assembly of FIG. 5B.
Figure 5D:
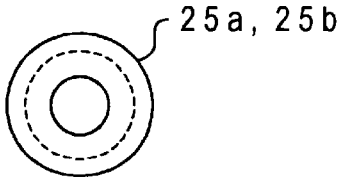
FIG. 5D is a front plan view of a pulley of FIG. 5B.
Figure 5E:
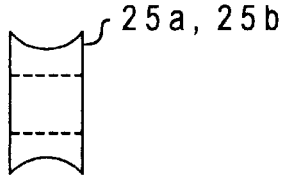
FIG. 5E is a top view of the pulley of FIG. 5D.
Figure 5F:
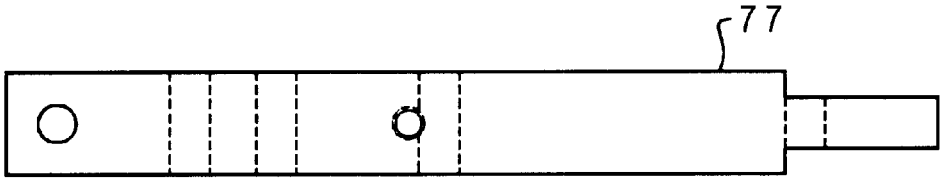
FIG. 5F is a top view of an alternate pulley assembly housing for use with the apparatus of FIG. 1.

Referring now to FIGS. 5A through 5F in the drawings, two wheel pulley assembly 21 of the present invention is illustrated in detail. In the preferred embodiment, two wheel pulley assembly 21 includes a housing 71 having a slotted portion 73. Housing portion 71 is coupled to flapper valve column 14 (see FIG. 1). As is best seen in FIGS. 5B and 5C, first chain 17 is fed over pulley 25*b* and under pulley 25*a*. First chain 17 may include a restrictor member 75 to limit the amount of first chain 17 that may be pulled over and around pulleys 25*a* and 25*b*. As is best seen in FIG. 5F, pulley housing 71 may be replaced with a bracket member 77 which carries pulleys 25*a* and 25*b*. As with pulley housing 71, bracket member 77 is preferably coupled to flapper valve column 14.

Figure 6A:
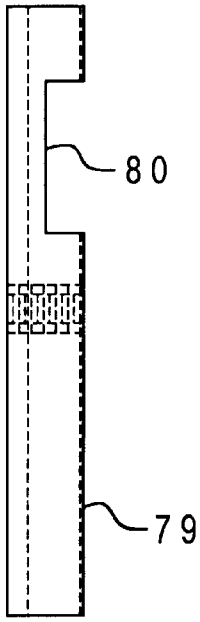
FIG. 6A is a front plan view of a clamp member for use with an alternate embodiment of the spring loaded release control mechanism of FIG. 1.
Figure 6B:
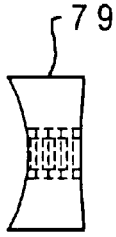
FIG. 6B is a top view of the clamp member of FIG. 6A.
Figure 6C:
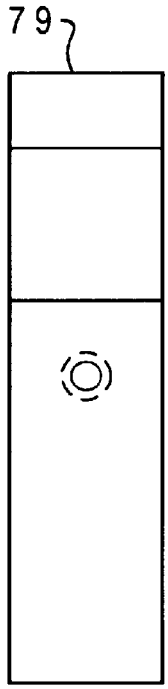
FIG. 6C is a right side view of the clamp member of FIG. 6A.

Referring now to FIGS. 6A through 6C in the drawings, a support bracket 79 is illustrated. Support bracket 79 would typically be used to secure base member 69 and/or sleeve member 39 to an existing structure in the tank. Support bracket 79 is clamped to base member 69 with a conventional ring clamp (not shown) through a slot 80. The combination of support bracket 79 and base member 69 and/or sleeve member 39 may be used when apparatus 11 is installed in a toilet of original manufacture or when apparatus 11 is installed as a retrofit in an existing tank for which base portion 37 cannot be used due to a configuration of the interior base surface of the tank.

Figure 7:
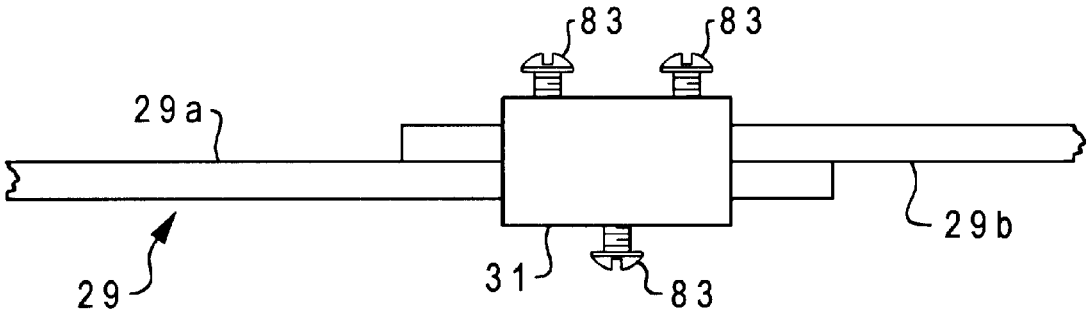
FIG. 7 is a top view of the adjustable activating rod of FIG. 1.

Referring now to FIG. 7 in the drawings, adjustable activating rod 29 is illustrated. In the preferred embodiment, adjustable activating rod 29 includes a first portion 29*a* and a second portion 29*b*. First portion 29*a* and second portion 29*b* are coupled together by adjustment mechanism 31. As is shown, adjustment mechanism 31 may include a plurality of fasteners 83. By adjusting the length of first portion 29*a* and second portion 29*b* and then tightening fasteners 83, adjustable activating rod 29 may be adjusted to precisely extend between dual action flush handle 33 and flapper valve column 14. It should be understood that adjustable activating rod 29 may be of various configurations, including telescoping and overlapping.

Figure 8:
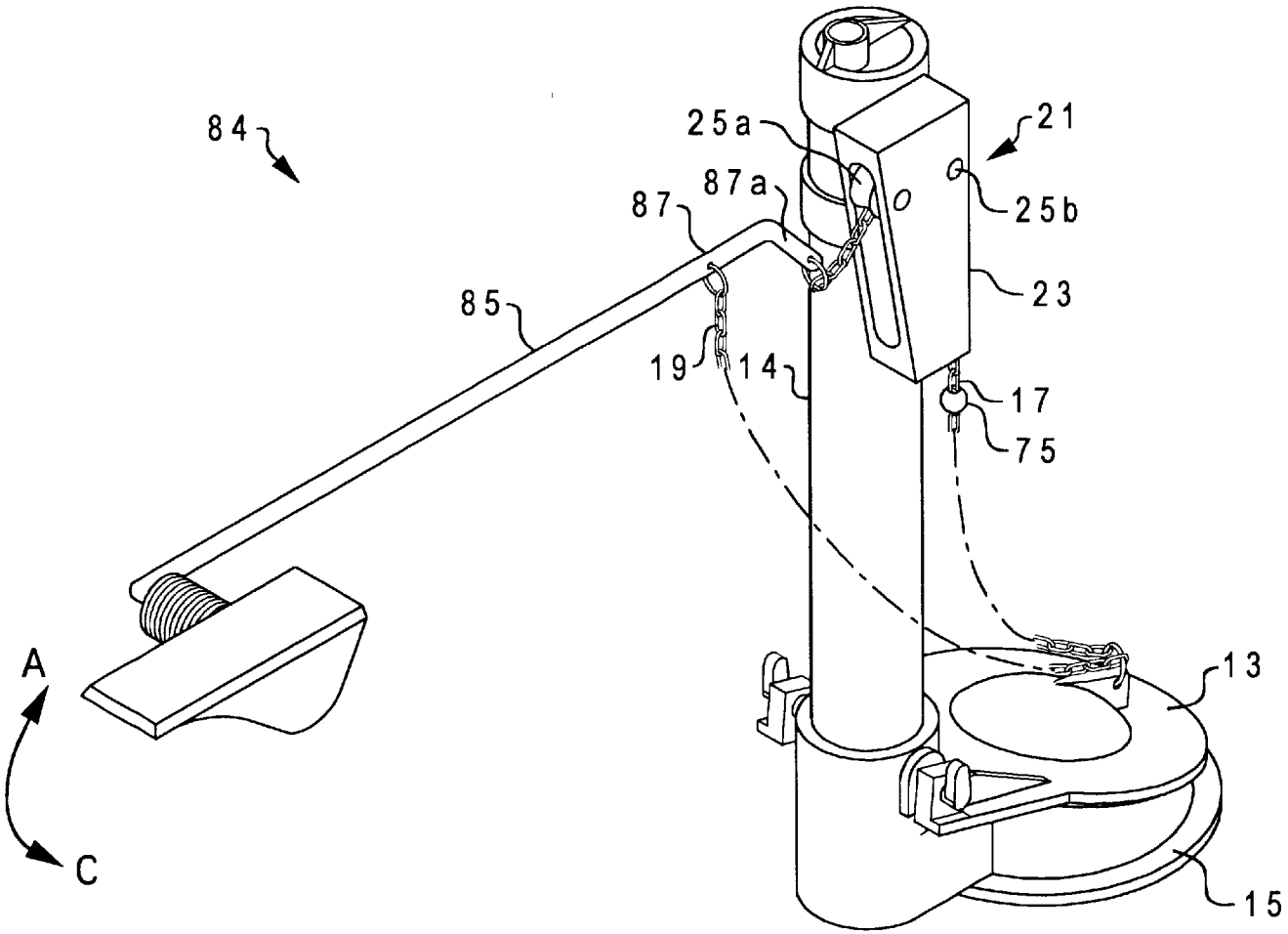
FIG. 8 is a prospective view of an alternate embodiment of the apparatus of FIG. 1.

Referring now to FIG. 8 in the drawings, an alternate embodiment of the apparatus of the present invention is illustrated. An apparatus 84 is illustrated. In this embodiment, adjustable activating rod 29 has been replaced by a fixed length rod 85. This embodiment is indicative of the present invention as used in a toilet of original manufacture, as opposed to being a retrofit into an existing toilet. As is shown, flapper valve 13 is pivotally coupled to flapper value column 14 and pivotally opens and closes flow outlet 15. First chain 17 is coupled to flapper valve 13 and is fed through two wheel pulley assembly 21 having pulleys 25*a* and 25*b*. First chain 17 includes a restrictor member 75 to restrict the movement of first chain 17 through pulley assembly 21. First chain 17 is coupled to an end portion 87 of fixed length rod 85. As with the preferred embodiment, end portion 87 may include a downward bend 87*a*. In a similar manner as with the preferred embodiment, second chain 19 is coupled to flapper valve 13 and fixed length rod 85. In this embodiment, spring loaded release control mechanism 35 is not necessary, thereby reducing the cost and complexity of apparatus 84.

In operation, the existing toilet flush handle and attached extension rod are removed. The existing chain between flapper valve 13 and the extension rod is also removed. Apparatus 11 is then placed installed into the tank of the existing toilet. Spring loaded release control mechanism 35 is placed on the bottom of the tank. Dual action flush handle 33 is installed through the aperture in the tank where the existing flush handle extended out from the tank. First portion 29*a* and second portion 29*b* of adjustable activating rod 29 are adjusted so that adjustable activating rod 29 extends from dual action flush handle 33 to a position near the existing flapper valve column 14. After first portion 29*a* and second portion 29*b* of adjustable activating rod 29 are 17 adjusted to the desired length, fasteners 83 are tightened to prevent relative motion of first portion 29*a* and second portion 29*b*. First chain 17 and second chain 19, which are coupled to first end portion 27 of adjustable activating rod 29, are then coupled to flapper valve 13 such that first chain 17 extends through two wheel pulley assembly 21. Two wheel pulley assembly 21 is secured to existing flapper valve column 14 by conventional means, such as a bracket or a ring clamp. The height of adjusting shaft member 45 is adjusted at adjustment portion 65 such that adjustable activating rod 29 is an appropriate distance above base portion 37. Then, adjustment members 51 are secured into base portion 37 at fixed end 53. Spring release control mechanism 35 is secured into place by extending adjustment ends 55 until stoppers 59 come into contact with the inside wall surfaces of the tank. Once adjustment ends 55 are so adjusted, lock nut 61 is tightened against fixed end 53 so that base portion 37 remains immobile within the tank.

Thus assembled, apparatus 11 transforms the existing single-action, full flush toilet into a dual action water conservation toilet. The toilet can now be flushed in either of two modes: a full flush mode or a restricted flush mode. To effectuate the full flush mode, dual action handle 33 is pushed downward in the direction of arrow B in FIG. 1. The effectuate the restricted flush mode, dual action handle 33 is pushed in the upward direction as indicated by arrow A in FIG. 1.

The weight of the water in the tank keeps flapper valve 13 in a closed position in which flapper valve 13 seals flow outlet 15. If the user wants to operate apparatus 11 in the full flush mode, he simply pushes down on dual action lever 33 in the direction of arrow B. This action causes adjustable activating rod 29 to pivot about dual action handle 33 and raise end portion 27. This action causes second chain 19 to pull up on flapper valve 13. The slack in the length of first chain 17 causes first chain 17 to have no appreciable effect on the operation of second chain 19 in the full flush mode. Once flapper valve 13 is raised over about 0.25 inches, the flow of water through flow outlet 15 and the buoyancy of flapper valve 13 force flapper valve into a fully open position in which the volume of water in the tank flushes through flow outlet 15. Flapper valve 13 does not begin to "float" back into the closed position over flow outlet 15 until the water level in the tank is below the level of flapper valve 13. Once flapper valve 13 again seals flow outlet 15, new water is pumped into the tank until its level is stopped by a floater valve (not shown). Thus, moving dual-action handle 33 in the direction of arrow is equivalent to a conventional full flush of the toilet.

On the other hand, if the user wants to operate apparatus 11 in the restricted flush mode, he simply pushes up on dual action handle 33 in the direction of arrow A. This action causes first chain 17 to be pulled over pulley 25*b* until the movement of adjustable activation rod 29 is restricted by spring release control mechanism 35, or in instances where restrictor member 75 is employed, when restrictor member 75 comes into contact with housing member 23 of pulley assembly 21. The movement of dual action handle 33 in the direction of arrow A is restricted by spring loaded release control mechanism 35. Such movement of dual action handle 33 results in lifting flapper valve 13 only about 0.25 inches above flow outlet 15. Such a limited lifting of flapper valve 13 prevents flapper valve 13 from being pushed by the flow of water and its own buoyancy into a fully upward position, as is normal in a full flush mode. As long as flapper valve 13 is not raised more than about 0.25 inches, flapper valve 13 will not be forced up into the fully opened position, but the water in the tank will continue to flow through flow outlet 15. In this manner, the user can control the amount of water that is drained from the tank, simply by controlling how long dual action handle is held in the direction of arrow A. Thus, the user can flush the toilet without using the full volume of the water in the tank. By using less water, more water is conserved. When the user releases dual action handle 33A back to its original position, flapper valve 13 returns to the position in which it seals flow outlet 15. At this point, water is filled back into the tank from the inlet, (not shown) until the water level is stopped by the existing floater valve (not shown).

Spring loaded release control mechanism 35 aids the user in moving the handle the appropriate distances to effectuate both the restricted flow mode and the full flush mode. This is accomplished because shaft member 45 is coupled to adjustable activating rod 29 and stopper member 43. Because post member 43A extends through elongated slot 47, the axial translation of shaft member 45 is restricted.

In the alternate embodiment discussed with reference to FIGS. 4A, 4B, and 6A through 6C, operation of apparatus 11 is identical to the operation described above, with the exception that base portion 37 is replaced by base portion 69 and support bracket 79. Base member 69 and support bracket 79 are used in instances when base portion 37 will not securely fit into the tank due to the configuration of the bottom interior surface of the tank.

Figure 9A:
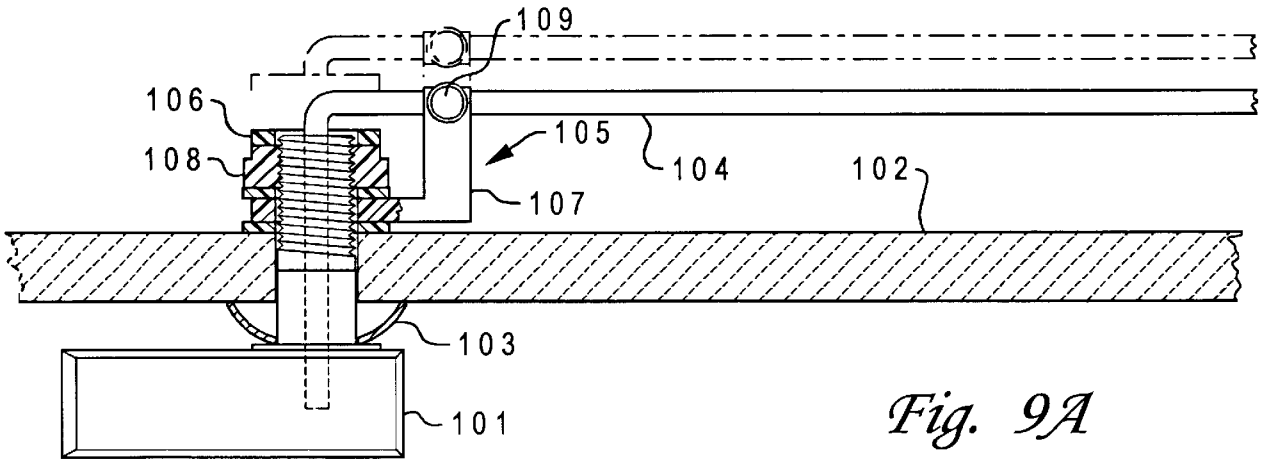
FIG. 9A is a top view of an alternate embodiment of the dual action handle of the apparatus of FIG. 1.
Figure 9B:
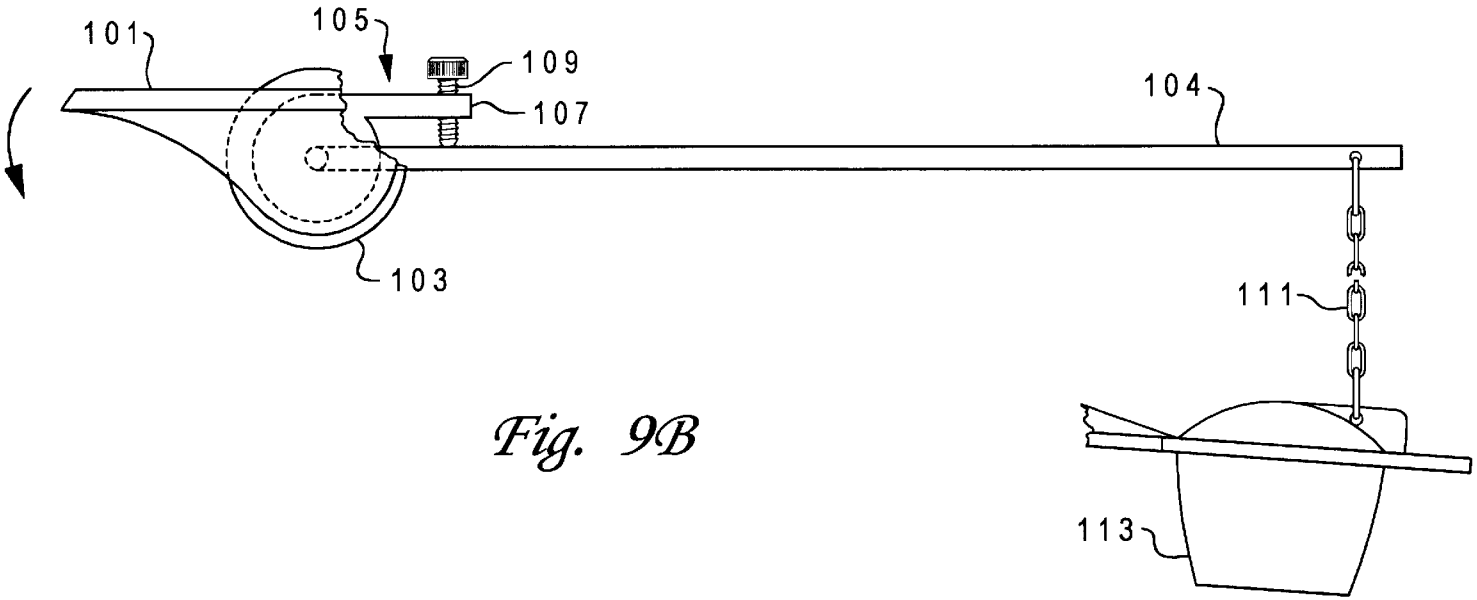
FIG. 9B is a front plan view of the dual action handle of the apparatus of FIG. 9A.

Referring now to FIGS. 9A and 9B in the drawings, an alternate embodiment of the dual action handle of the apparatus of the present invention is illustrated. In this embodiment, dual action handle 33, which pivots both upward and downward, is replaced with dual action handle 101, which only pivots downward, but which has two positions in which it can be pivoted downward, a first position for the restricted flush mode and a second position for the full flush mode. Dual action handle 101 is biased into the first position by a leaf spring 103. Dual action handle 101 passes through a tank wall 102 and is coupled to a transfer rod 104, which may be either of adjustable length or fixed length, depending upon whether the apparatus is installed as a retrofit into an existing toilet, or whether the apparatus 11 is installed in a toilet of original manufacture. A grommet 106 and a threaded adapter 108 may be coupled between dual action handle 101 and transfer rod 104. An adjustable restrictor assembly 105 is operably associated with dual action handle 101. Adjustable restrictor assembly 105 includes an attachment portion 107 and an adjustment member 109. Adjustment member 109 is preferably a screw, but may also be a slider, cam, or other such device. Transfer rod 104 is coupled to a pull chain 111 which is coupled to the existing flapper valve 113.

In this embodiment, if the user wants to perform a restricted flush operation, he simply pushes downward on dual action handle 101. Because dual action handle 101 is biased outward by leaf spring 103, downward movement of dual action handle 101 causes transfer rod 104 to pivot about dual action handle 101 in an upward direction. However, the pivotal movement of transfer rod 104 is selectively restricted by the adjustment of adjustment member 109. When properly adjusted, the restricted movement of dual action handle 101 results in flapper valve 113 moving upward only about 0.25 inches, as explained above. In this manner, the user has the option of flushing only a portion of the volume water out of the tank.

On the other hand, if the user wants to perform a full flush operation, he simply pushes inward on dual action handle 101 towards tank wall 102 and against leaf spring 103. The user simultaneously pushes downward on dual action handle 101. This dual action of pushing inward and downward causes transfer rod 104 to clear adjustment member 109 of adjustable restrictor assembly, as indicated in phantom in FIG. 9A. Because the pivotal movement of transfer rod 104 is not restricted, transfer rod 104 pivots upward fully, thereby fully lifting flapper valve 113 and causing a full flush of the toilet as described above.

In the alternate embodiment of FIG. 8, which is used in toilets of original manufacture, apparatus 84 functions in an identical manner as described above, with the exception that spring release control mechanism is not present. In this embodiment, the restricted flush mode is restricted by restrictor member 75 in first chain 17.

Although the present invention is shown in a limited number of forms, it is not limited to just these forms, but is amenable to various changes and modifications without departing from the spirit thereof.

I claim:

1. A water conservation apparatus for use in a toilet tank comprising:

a dual action handle;

an adjustable activating rod coupled to the dual action handle;

a first pull chain for effectuating a full tank flush coupled to the adjustable activating rod and being adapted for coupling to a flapper valve within the toilet tank;

a second pull chain for effectuating a limited flush coupled to the adjustable activating rod and being adapted for coupling to a flapper valve within the toilet tank; and a release control mechanism coupled to the adjustable activating rod for regulating the pivotal movement of the dual action handle and the adjustable activating rod.

2. The water conservation apparatus according to claim 1, further comprising:

a stabilizing jackscrew assembly carried by the release control mechanism for securing the water conservation apparatus within the toilet tank.

3. The water conservation apparatus according to claim 1, wherein the release control mechanism is spring loaded.

4. The water conservation apparatus according to claim 1, further comprising:

a pulley assembly for controlling whether a full tank flush is effectuated or a limited tank flush is effectuated as determined by the actuation of the dual action handle.

5. The water conservation apparatus according to claim 1, wherein the dual action handle pivots in one direction to effectuate the full tank flush and in the opposite direction to effectuate the limited tank flush.

* * * * *